US006700462B2

(12) United States Patent
Nakamura et al.

(10) Patent No.: US 6,700,462 B2
(45) Date of Patent: Mar. 2, 2004

(54) MICROSTRIP LINE FILTER COMBINING A LOW PASS FILTER WITH A HALF WAVE BANDPASS FILTER

(75) Inventors: Makio Nakamura, Osaka (JP); Atsushi Nagano, Osaka (JP); Mitsutoshi Okami, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/216,895

(22) Filed: Aug. 13, 2002

(65) Prior Publication Data

US 2003/0034860 A1 Feb. 20, 2003

(30) Foreign Application Priority Data

Aug. 20, 2001 (JP) ..... 2001-248967

(51) Int. Cl.[7] ..... H01P 1/20; H01P 3/08
(52) U.S. Cl. ..... 333/204; 333/246
(58) Field of Search ..... 333/204, 205, 333/185, 1.1, 246; 505/210

(56) References Cited

U.S. PATENT DOCUMENTS 5,357,227 A * 10/1994 Tonegawa et al. ..... 333/185
6,377,141 B1 * 4/2002 Hirabayashi ..... 333/204
6,483,403 B2 * 11/2002 Hirabayashi et al. ..... 333/204
6,525,630 B1 * 2/2003 Zhu et al. ..... 333/205
6,590,476 B2 * 7/2003 Lee et al. ..... 333/204

FOREIGN PATENT DOCUMENTS

JP 1-218103 8/1989
JP 2000-278027 10/2000

* cited by examiner

*Primary Examiner*—Patrick Wamsley
(74) *Attorney, Agent, or Firm*—Birch, Stewart, Kolasch & Birch, LLP

(57) ABSTRACT

A plurality of composite elements are arranged in parallel with each other on a substrate. The composite elements each include a rectangular microstrip line element, an input microstrip line and an output microstrip line. The microstrip line element has one longer side, the other longer side, one end and the other end, and the input microstrip line is connected at the one end to the one longer side while the output microstrip line is connected at the other end to the other longer side. The composite elements are cascaded to constitute a low-pass filter.

11 Claims, 12 Drawing Sheets

MICROSTRIP LINE FILTER COMBINING A LOW PASS FILTER WITH A HALF WAVE BANDPASS FILTER

BACKGROUND OF THE INVENTION

1. Field of the Invention

The present invention relates to a microstrip line filter and a high-frequency transmitter using the microstrip line filter. In particular, the present invention relates to a microstrip line filter constituting a low-pass filter which eliminates any unwanted radiation and relates to a high-frequency transmitter using the microstrip line filter.

2. Description of the Background Art

In recent years, the radio (high-frequency) communication has undergone remarkable developments in numerous systems like the broadcast and communication satellites for example. On the other hand, the widespread use of the Internet has caused increasing demands for the two-way communication.

FIG. 11 schematically shows a system for two-way communication by means of a communication satellite. Referring to FIG. 11, an IDU (indoor unit) 1 is contained within a television receiver or housed in a board in a personal computer, and processes a signal for two-way communication with a broadcast station via a communication satellite 2. IDU 1 is connected to a high-frequency transmitter 4 via a transmission-adapted coaxial cable 3 and IDU 1 is also connected to an LNB (low noise block down converter) 6 via a reception-adapted coaxial cable 5.

High-frequency transmitter 4 and LNB 6 are coupled to a feed horn 8 via an orthogonal polarization isolator 7. A transmission signal from high-frequency transmitter 4 is radiated as the microwave from feed horn 8, reflected by a parabolic antenna 9 and transmitted toward communication satellite 2. The microwave from communication satellite 2 is reflected by parabolic antenna 9 and then received by LNB 6 via feed horn 8.

FIG. 12 is a block diagram of the high-frequency transmitter employed in the system shown in FIG. 11. Referring to FIG. 12, high-frequency transmitter 4 receives, from IDU 1 shown in FIG. 11, a transmission signal of an intermediate frequency ranging from 950 to 1450 MHz superimposed on a direct-current voltage. The intermediate-frequency signal is supplied via a high-pass filter (HPF) 401 to an IF amplifier 402 to obtain a gain, adjusted to a proper level by an attenuator 403, further amplified by an IF amplifier 404, and then supplied to a mixer 406 via a bandpass filter (BPF) 405.

A local oscillator 407 generates a local oscillator signal of 13.05 GHz which is provided via a buffer amplifier 408 to mixer 406. Mixer 406 combines the local oscillator signal of 13.05 GHz with the intermediate-frequency signal of 950–1450 MHz in order to convert the intermediate-frequency signal into a high-frequency signal of 14.0–14.5 GHz. The high-frequency signal supplied from mixer 406 is input to a half-wave bandpass filter 409 where any unwanted radiation component (spurious radiation component) of the high-frequency signal that is generated in mixer 406 is attenuated, and then amplified by two high-frequency amplifiers 410 and 411 to obtain a great gain.

The output from high-frequency amplifier 411 is supplied to a bandpass filter 412 where the amplified spurious component is attenuated, and then supplied to a driver amplifier 413 to obtain a further gain. The output from driver amplifier 413 is supplied to a reception-bandwidth noise filter 414 where any noise level in a reception frequency range is substantially reduced to a thermal noise level. Then, the high-frequency signal is converted by a power amplifier 415 to a signal of high power required for transmission to the satellite. The high-frequency signal from power amplifier 415 is provided to a reception-bandwidth noise filter 416 where the noise level in the reception frequency range that is increased from the thermal noise level due to the gain of power amplifier 415 is attenuated, and then the signal supplied via noise filter 416 from high-frequency transmitter 4 is radiated as the microwave from feed horn 8, reflected by parabola antenna 9 and transmitted toward communication satellite 2 that are shown in FIG. 11.

The DC voltage with the intermediate-frequency signal superimposed thereon is supplied via an inductor L to a power supply circuit 421. Inductor L prevents the intermediate-frequency signal from being input to power supply circuit 421. Power supply circuit 421 converts the supplied DC voltage into a predetermined voltage which is provided to a power supply sequence circuit 422. Then, the converted DC voltage is supplied to IF amplifiers 402 and 404, mixer 406, local oscillator 407, buffer amplifier 408, high-frequency amplifiers 410 and 411, driver amplifier 413 and power amplifier 415.

In high-frequency transmitter 4 shown in FIG. 12, the gain of IF amplifiers 402 and 404 and the degree or amount of attenuation by attenuator 403 are adjusted to prevent the output level from varying when the level of the input intermediate-frequency signal varies in the range from −5 dBm to −25 dBm. Even if a high-level signal of approximately −5 dBm is input, IF amplifiers 402 and 404 operate in a saturation region to distort the signal component in order to output the signal at a predetermined level. However, the distorted signal component generates harmonic components resulting in increase of spurious components.

Any spurious of 14.95–15.95 GHz generated in mixer 406 resultant from mixing of the input signal of twice the frequency of 950 MHz–1450 MHz and the local oscillator signal of 13.05 GHz differs from the output frequency range 14 GHz–14.5 GHz of high-frequency transmitter 4 merely by 450 MHz. Then, in order to reduce such a spurious, a microstrip filter as shown in FIG. 13 is used as the half-wave bandpass filter 409 shown in FIG. 12.

The microstrip filter shown in FIG. 13 includes a plurality of (e.g. 8) rectangular elements shifted so that respective halves of the longitudinal sides of respective elements are opposite to and in parallel with each other. This bandpass filter 409 has a passband of 14 GHz–14.5 GHz so as to attenuate an image-frequency signal of 11.6–12.1 GHz and a signal above 14.5 GHz. However, proper attenuation of the spurious of 14.95 GHz which is close to 14.5 GHz could be impossible.

FIG. 14 shows cutoff characteristics of a combination of half-wave bandpass filter 409 and high-frequency amplifiers 410 and 411. It is seen from FIG. 14 that the attenuation achieved by the cutoff characteristics is merely 11.9 dB, which means that an attenuation of 20 dB or more by half-wave bandpass filter 409 with its elements arranged as shown in FIG. 13 is extremely difficult. Even if attenuation of at least 20 dB is possible, it is impossible to make the cutoff characteristics more steeper.

SUMMARY OF THE INVENTION

One object of the present invention is to provide a microstrip line filter constituting a low-pass filter with a large out-of-band attenuation and a small in-band deviation, and to provide a high-frequency transmitter employing the microstrip line filter.

In summary, according to one aspect of the present invention, a microstrip line filter formed on a substrate includes a plurality of composite elements arranged in parallel with each other. The composite elements each include a rectangular microstrip line element, an input microstrip line and an output microstrip line that are formed on the substrate. The composite elements are connected to constitute a low-pass filter.

The rectangular microstrip line element has one longer side, the other longer side, one end and the other end. The input microstrip line is connected at the one end to the one longer side, and the output microstrip line is connected at the other end to the other longer side.

The composite elements adjacent to each other have respective input microstrip line and output microstrip line connected to each other and, the adjacent composite elements are symmetrical with respect to a center line between the input microstrip line and the output microstrip line connected to each other of the adjacent composite elements respectively.

Rectangular microstrip line elements of the composite elements differ in the length of longer side.

The rectangular microstrip line elements include outer microstrip line elements and inner microstrip line elements. The inner microstrip line elements have longer sides shorter than those of the outer microstrip line elements to obtain desired input/output impedance characteristics, in-band pass characteristics and out-of-band attenuation characteristics.

Microstrip line elements of the composite elements are arranged symmetrically with respect to a center line of the arrangement of the composite elements, and the microstrip line filter includes a metal casing having a partition on the center line and covering microstrip line elements of the composite elements.

Microstrip line elements of the composite elements have respective input microstrip lines and respective output microstrip lines that connect the microstrip line elements and that have respective widths selected to obtain desired input/output impedance characteristics, in-band pass characteristics and out-of-band attenuation characteristics.

A half-wave bandpass filter connected in series to the low-pass filter is further formed on the substrate.

The half-wave bandpass filter includes a plurality of rectangular microstrip line elements arranged in parallel with each other at predetermined intervals and inclined at a certain angle, and halves of respective longitudinal sides of the microstrip line elements are opposite to halves of respective longitudinal sides of adjacent microstrip line elements.

According to another aspect of the present invention, a high-frequency transmitter converts an intermediate-frequency signal into a high-frequency signal and transmits the high-frequency signal. The high-frequency transmitter includes a mixer circuit combining the intermediate-frequency signal with a local oscillator signal, a filter circuit connected to an output of the mixer circuit, and a high-frequency amplifier circuit connected to an output of the filter circuit. The filter circuit is formed on a substrate and includes a half-wave bandpass filter including a plurality of rectangular microstrip line elements that are arranged in parallel with each other at predetermined intervals and inclined at a certain angle, halves of respective longitudinal sides of the microstrip line elements being opposite to halves of respective longitudinal sides of adjacent microstrip line elements. The filter circuit further includes a low-pass filter including a plurality of composite elements arranged in parallel with each other and cascaded, the composite elements including respective rectangular microstrip line elements, respective input microstrip lines and respective output microstrip lines.

According to the present invention, the low-pass filter provides a large out-of-band attenuation and a small in-band deviation and accordingly has improved spurious elimination characteristics. Specifically, attenuation of at least 40 dB out of the passband above the higher limit of the passband is achieved all the time without deterioration in deviation within the passband and accordingly elimination of spurious above 14.95 GHz is possible.

In addition, the low-pass filter of the present invention has composite elements symmetrically arranged. Specifically, composite elements adjacent to each other are symmetrical with respect to the center line between respective input and output lines connected to each other. Accordingly, the low-pass filter occupies a minimum space as compared with composite elements that are simply cascaded.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
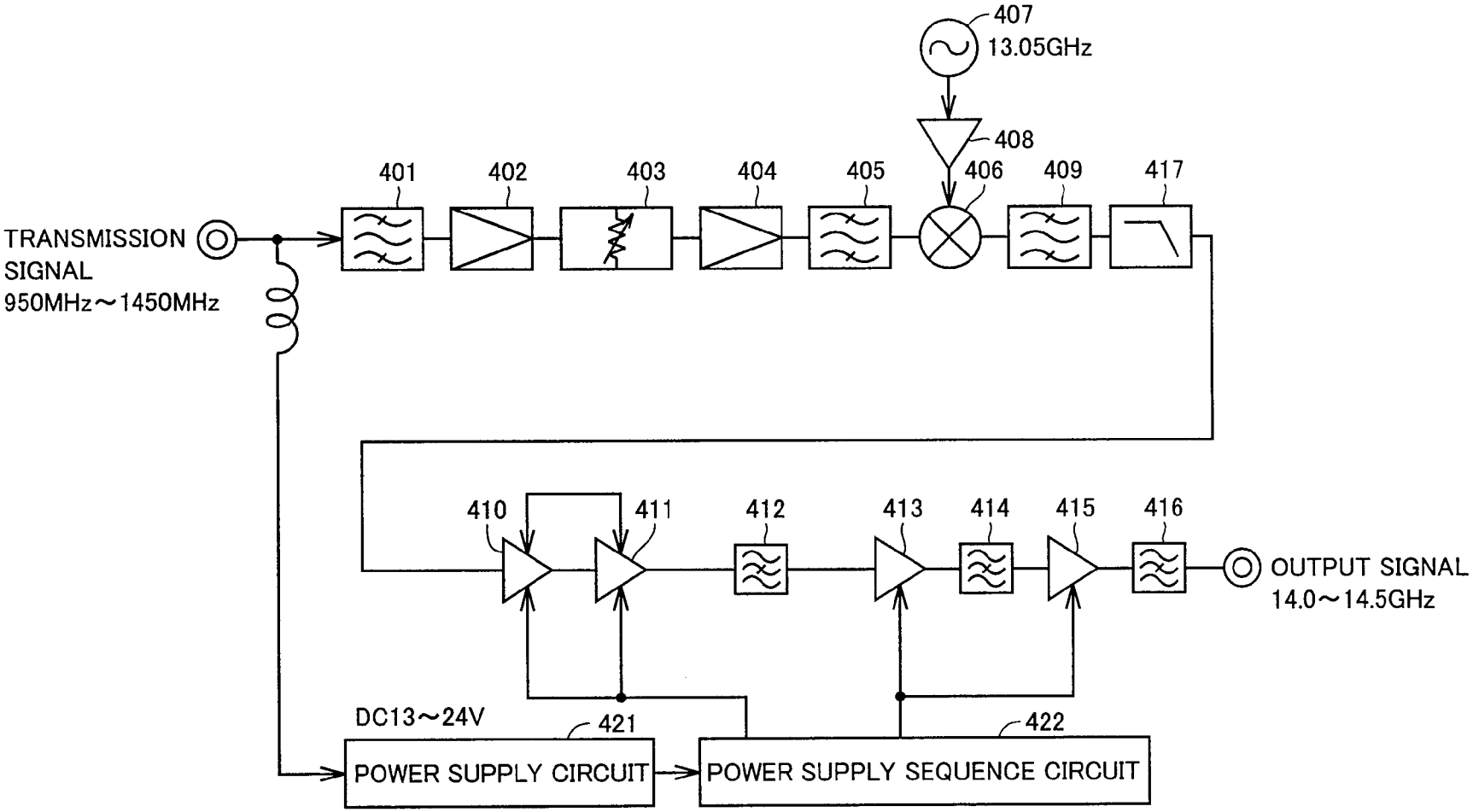
FIG. 1 is a block diagram of a high-frequency transmitter including a microstrip line filter according to one embodiment of the present invention.
Figure 12:
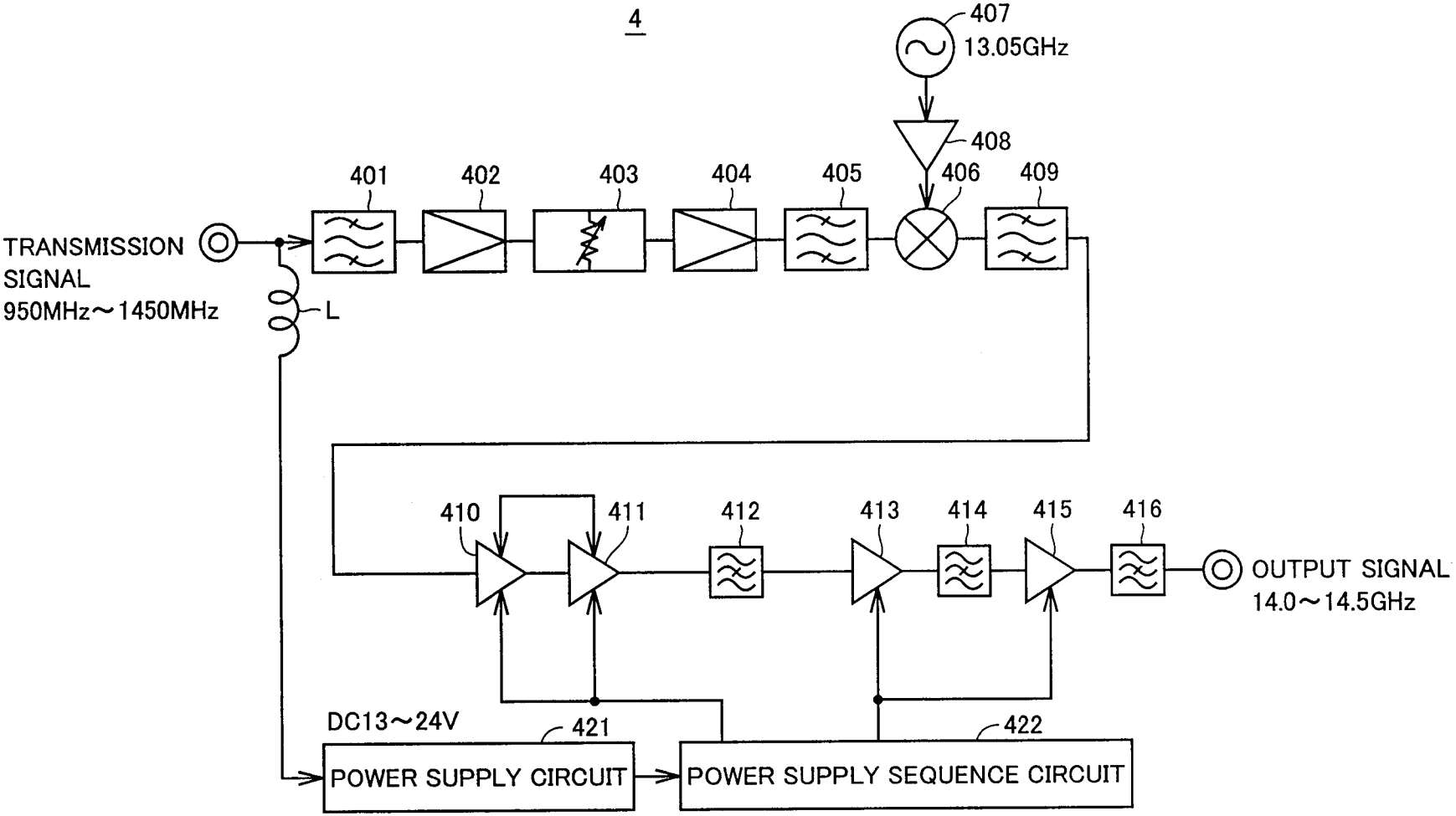
FIG.12 PRIOR ART
FIG. 12 is a block diagram of a high-frequency transmitter used in the system shown in FIG. 11.

FIG. 1 is a block diagram of a high-frequency transmitter including a microstrip line filter according to one embodiment of the present invention. Referring to FIG. 1, high-frequency transmitter receives, as the conventional transmitter shown in FIG. 12, a transmission signal of an intermediate frequency ranging from 950 to 1450 MHz superimposed on a direct-current voltage. The intermediate-frequency signal is supplied via a high-pass filter (HPF) 401 to an IF amplifier 402 to obtain a certain gain, adjusted to a proper level by an attenuator 403, further amplified by an IF amplifier 404, and then supplied to a mixer 406 via a bandpass filter (BPF) 405.

A local oscillator 407 generates a local oscillator signal of 13.05 GHz which is provided via a buffer amplifier 408 to mixer 406. Mixer 406 combines the local oscillator signal of 13.05 GHz with the intermediate-frequency signal of 950–1450 MHz in order to convert the intermediate-frequency signal into a high-frequency signal of 14.0–14.5 GHz. The high-frequency signal supplied from mixer 406 is input to a half-wave bandpass filter 409 and a low-pass filter 417 characterizing the invention where an unwanted radiation component (spurious radiation component) of the high-frequency signal that is generated in mixer 406 is attenuated.

According to this embodiment, half-wave bandpass filter 409 and low-pass filter 417 are combined to achieve attenuation of frequencies higher than 14.95 GHz by at least 40 dB all the time. The high-frequency signal with its spurious component thus attenuated is then amplified by two high-frequency amplifiers 410 and 411 to obtain a great gain.

Figure 11:
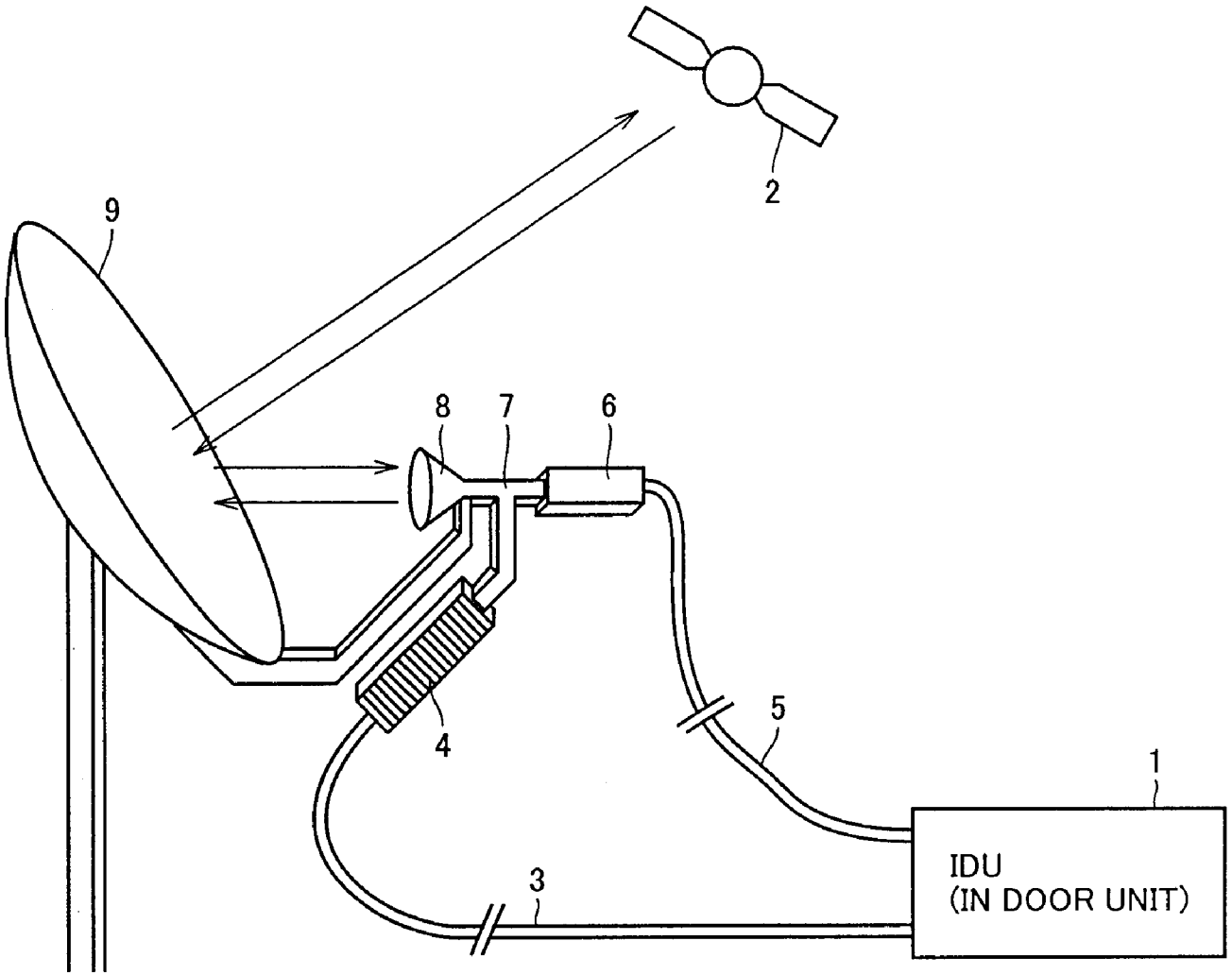
FIG.11 PRIOR ART
FIG. 11 schematically shows a system for two-way communication via a communication satellite.

The output from high-frequency amplifier 411 is supplied to a bandpass filter 412 where the amplified spurious component is attenuated, and then supplied to a driver amplifier 413 to obtain a further gain. The output from driver amplifier 413 is supplied to a reception-bandwidth noise filter 414 where any noise level in a reception frequency range is substantially reduced to a thermal noise level. Then, the high-frequency signal is converted by a power amplifier 415 to a signal of high power required for transmission to the satellite. The high-frequency signal from power amplifier 415 is provided to a reception-bandwidth noise filter 416 where the noise level in the reception frequency range that is increased from the thermal noise level due to the gain of power amplifier 415 is attenuated, and then the signal supplied via noise filter 416 from high-frequency transmitter 4 is radiated as the microwave from a feed horn 8, reflected by parabola antenna 9 and transmitted toward communication satellite 2 that are shown in FIG. 11.

Figure 2:
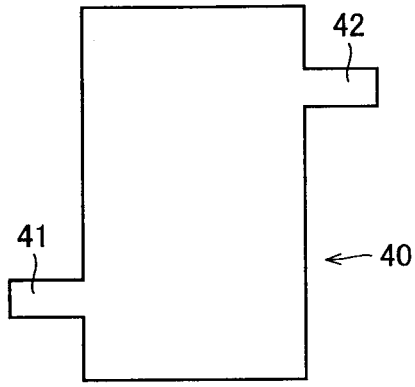
FIG. 2 shows a shape of an element of the microstrip line filter according to the embodiment of the present invention.

FIG. 2 shows a shape of an element of the microstrip line filter, as one component of low-pass filter 417 shown in FIG. 1, according to the embodiment of the present invention.

Referring to FIG. 2, the microstrip line filter uses, as a substrate material, a double-sided substrate (dielectric constant: 2.65, copper foil thickness: 20 $\mu$m, thickness: 0.61 mm). The line element 40 is rectangular in shape. An earth electrode of copper foil is formed on the entire rear surface of line element 40. One of the longer sides of line element 40 has an end where an input microstrip line 41 is formed, and the other side of line element 40 has an end where an output microstrip line 42 is formed. The composite element is accordingly formed.

Figure 3:
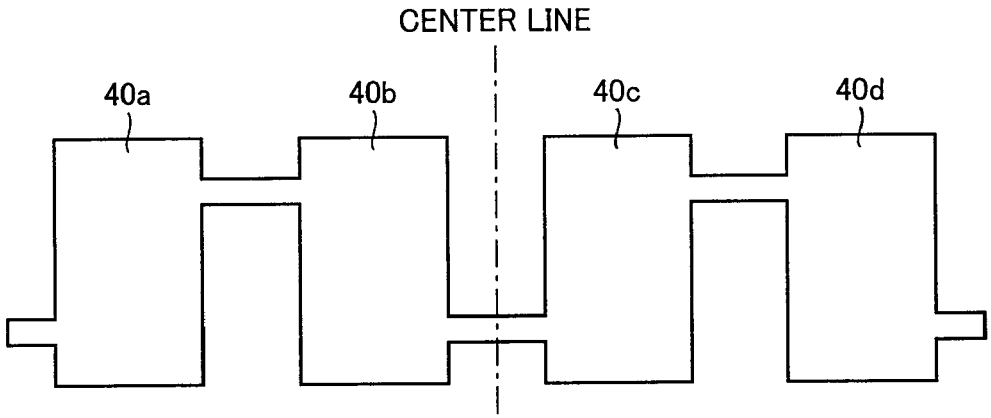
FIG. 3 shows a shape of a low-pass filter according to the embodiment of the present invention.

FIG. 3 shows a shape of the low-pass filter according to the embodiment of the present invention. Referring to FIG. 3, low-pass filter 417 shown in FIG. 1 includes line elements 40*a*–40*d* as shown in FIG. 2. At least four line elements are cascaded each having input microstrip line 41 connected to output microstrip line 42 of an adjacent line element, and the line elements adjacent to each other are symmetrical with respect to a center line between the connected input microstrip line 41 and output microstrip line 42. Preferably, line elements 40*a*–40*d* are symmetrical with respect to a center line which evenly divides the arrangement of the line elements.

The low-pass filter shown in FIG. 3 can be represented by a distributed constant circuit of LCR.

Figure 4:
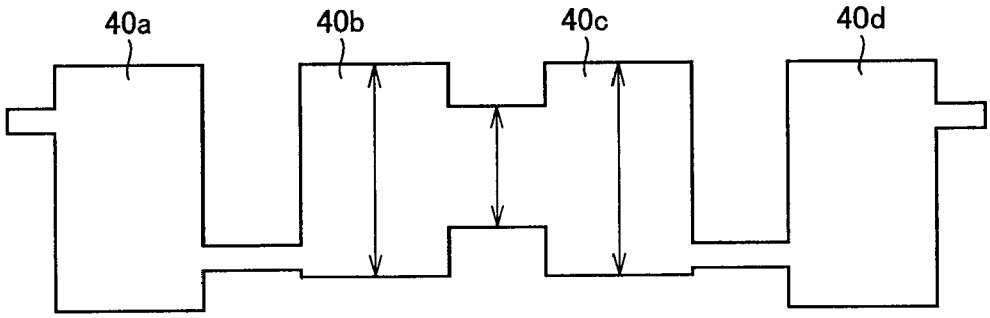
FIG. 4 shows a shape of the low-pass filter according to another embodiment of the present invention.

FIG. 4 shows a shape of the low-pass filter according to another embodiment of the present invention. According to this embodiment, in order to obtain desired input/output impedance characteristics, in-band pass characteristics and out-of-band attenuation characteristics, central line elements 40*b* and 40*c* have longer sides that are shorter than those of outer line elements 40*a* and 40*d*. Moreover, any width of the microstrip line connecting line elements 40*b* and 40*c* to each other is selected so as to obtain desired input/output impedance characteristics, in-band pass characteristics and out-of-band attenuation characteristics.

Figure 5:
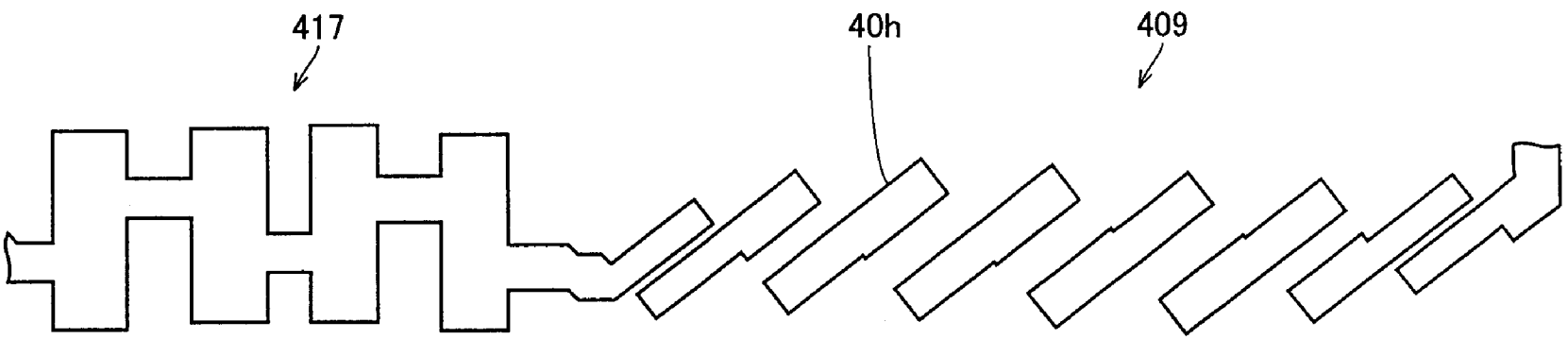
FIG. 5 shows respective shapes of the low-pass filter and a half-wave bandpass filter according to the present invention.

FIG. 5 shows the low-pass filter and the half-wave bandpass filter of the present invention. Low-pass filter 417 and half-wave bandpass filter 409 connected in series shown in FIG. 2 are formed on a substrate. Half-wave bandpass filter 409 includes a plurality of rectangular microstrip line elements 40*h* inclined at a certain angle and arranged in parallel with each other at predetermined intervals. The microstrip line elements 40*h* have respective halves of the longitudinal sides opposite to those of adjacent microstrip line elements 40*h*.

Figure 6A:
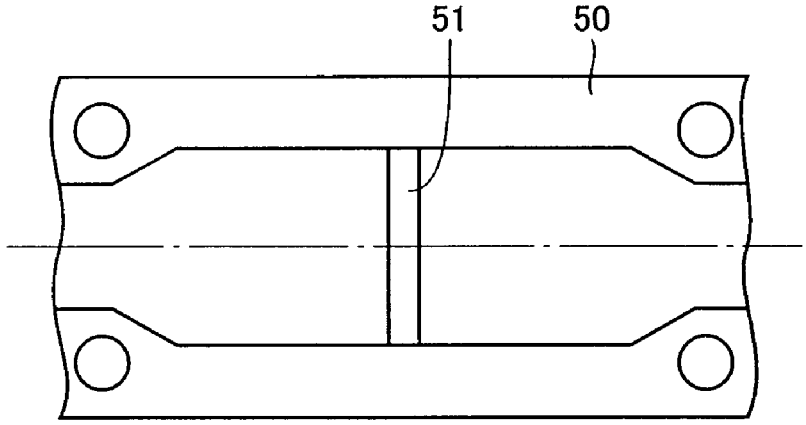
FIGS. 6A–6C show the low-pass filter housed in a metal casing according to the present invention, FIGS. 6A and 6B showing cross sections of principal parts of the low-pass filter and FIG. 6C showing a plan view thereof.
Figure 6B:
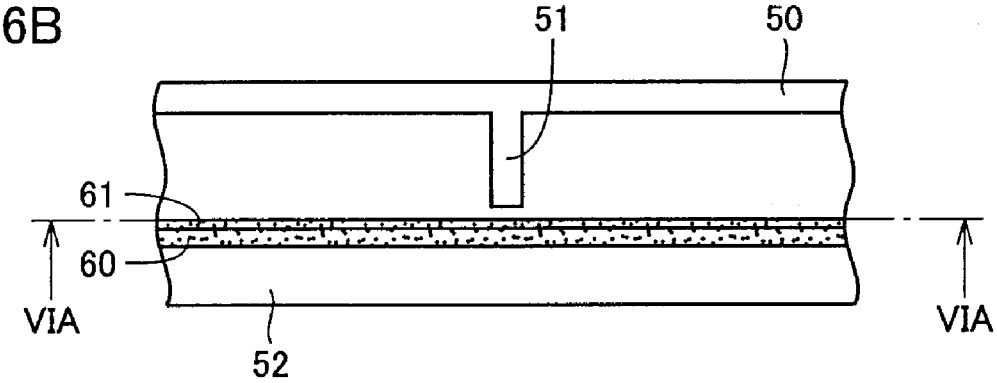
Figure 6C:
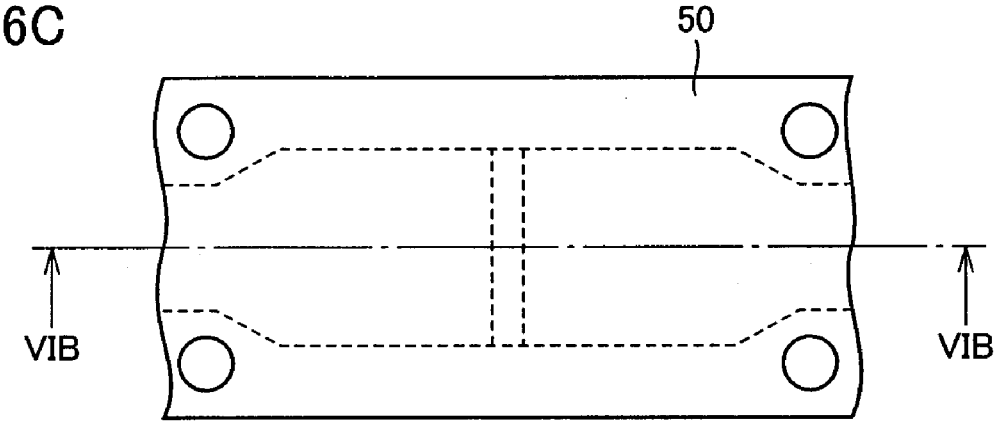

FIGS. 6A–6C each show a principal part of the low-pass filter of the present invention housed in a metal casing. FIG. 6A shows a cross section along line VIA—VIA in FIG. 6B, FIG. 6B shows a cross section along line VIB—VIB in FIG. 6C, and FIG. 6C is a plan view of the metal casing.

Referring to FIG. 6B, a substrate 60 with a pattern 61 for the microstrip line filter formed thereon is mounted on a chassis 52. A frame 50 has a rib 51 on pattern 61 on substrate 60 for reinforcing and shielding purposes.

In this way, patterns 61 of the microstrip line filter are covered with frame 50 and shielded from each other by rib 51 so as to reduce leakage of the spurious component to the outside.

Figure 7:
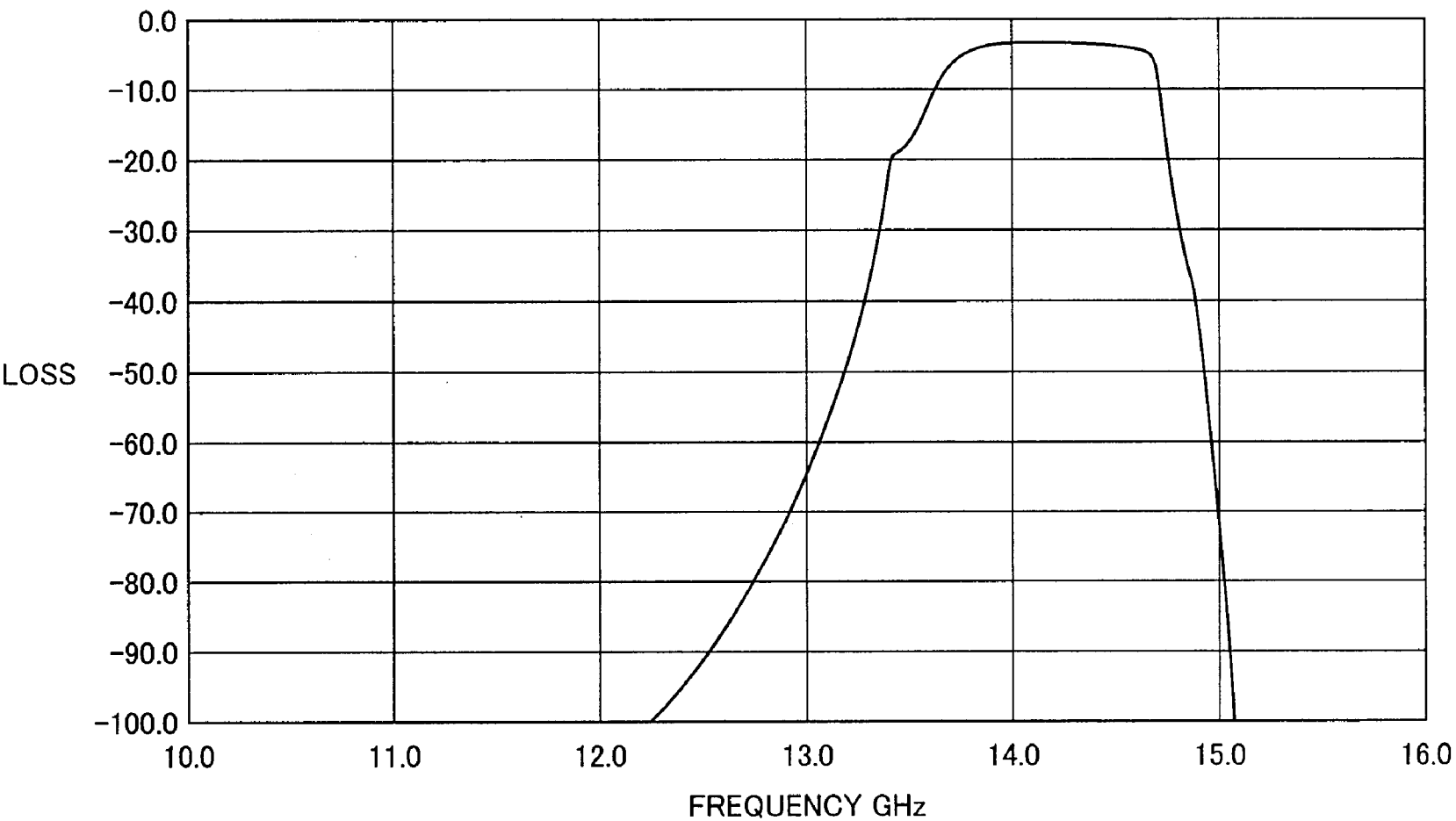
FIG. 7 shows signal pass characteristics of the half-wave bandpass filter and the low-pass filter shown in FIG. 5 connected in series, the characteristics being obtained through simulation.

FIG. 7 shows signal pass characteristics of the half-wave bandpass filter and the low-pass filter shown in FIG. 5 connected in series, the characteristics being obtained through simulation. Referring to FIG. 7, the passband of transmission frequencies is 14–14.5 GHz, and optimization is achieved by minimizing the loss within the passband (in-band loss) and maximizing the attenuation range out of the passband above 14.95 GHz (out-of-band attenuation). Specifically, the loss of the transmission frequency is 4 dB or less and the attenuation out of the passband above 14.95 GHz is at least 52 dB.

Figure 8:
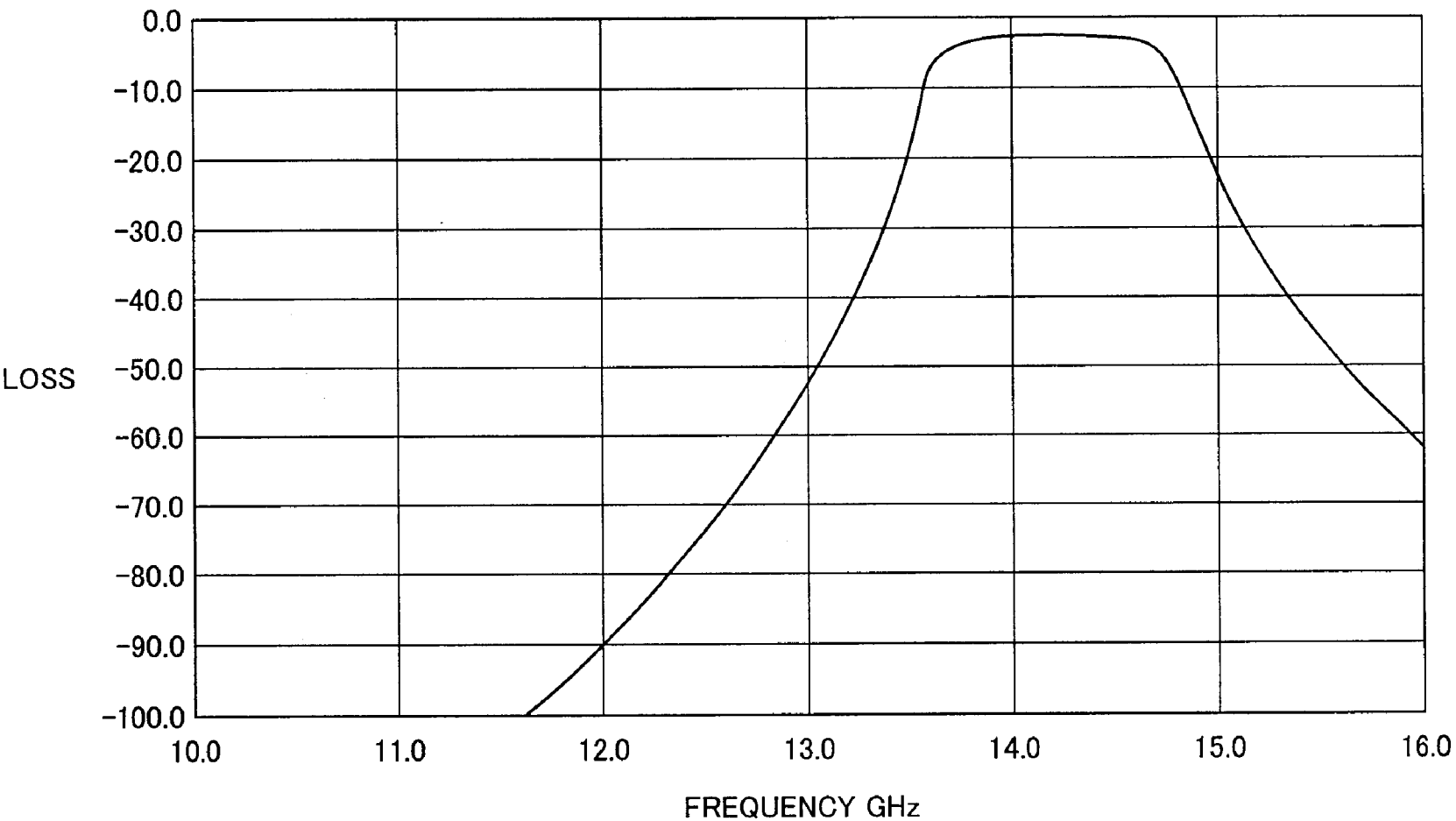
FIG. 8 shows signal pass characteristics of a conventional half-wave bandpass filter obtained through simulation.

FIG. 8 shows signal pass characteristics of the conventional half-wave bandpass filter obtained through simulation. It is seen from FIG. 8 that the characteristics shown in FIG. 7 exhibit improvements in the amount of attenuation of 32.9 dB, i.e., from 19.1 dB to 52 dB, of the receiving frequency. Moreover, the steeper cutoff characteristics shown in FIG. 7 as compared with FIG. 8 show that the ability of reducing the spurious component is improved.

Figure 9:
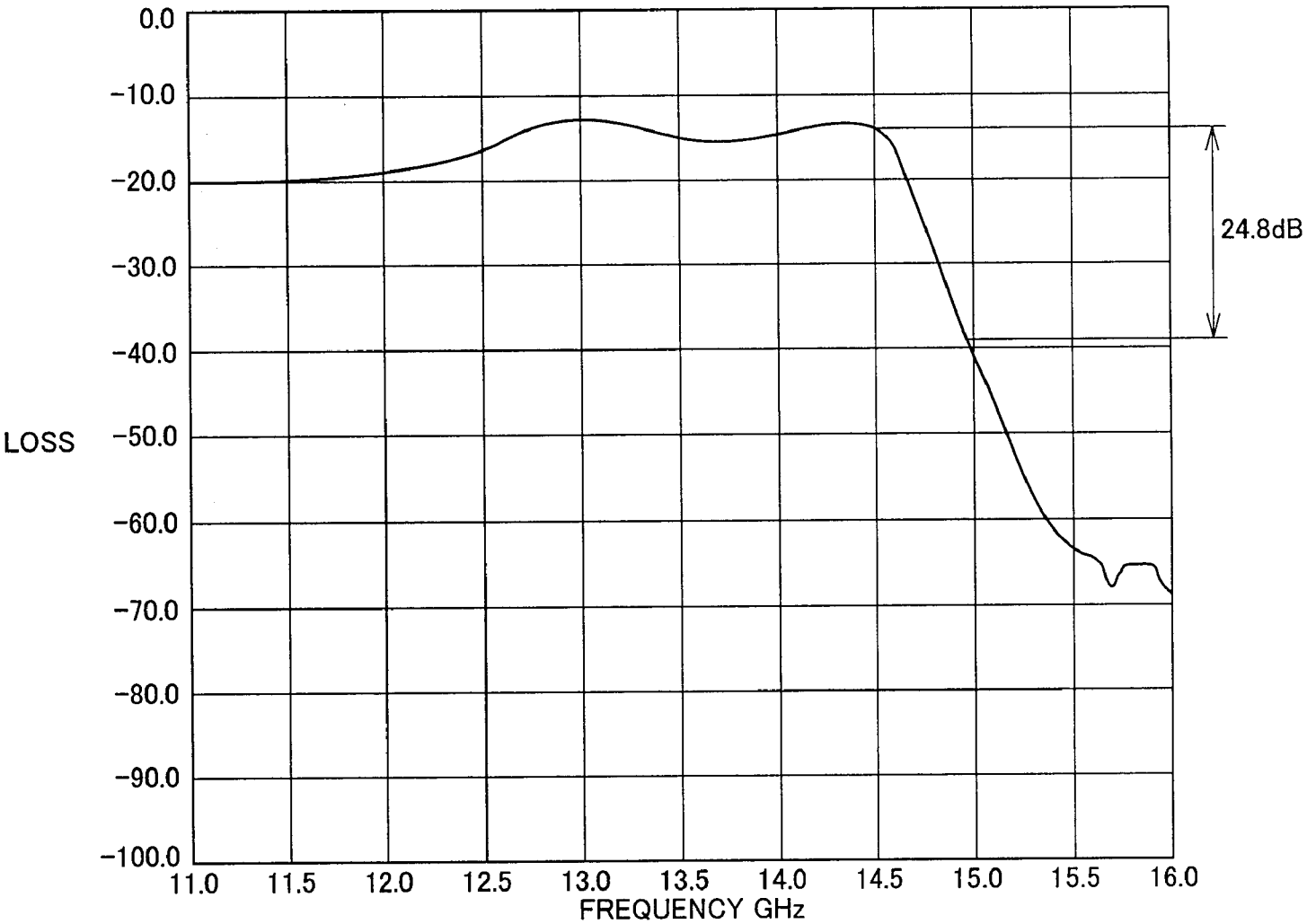
FIG. 9 shows cutoff characteristics of the low-pass filter of the present invention.
Figure 10:
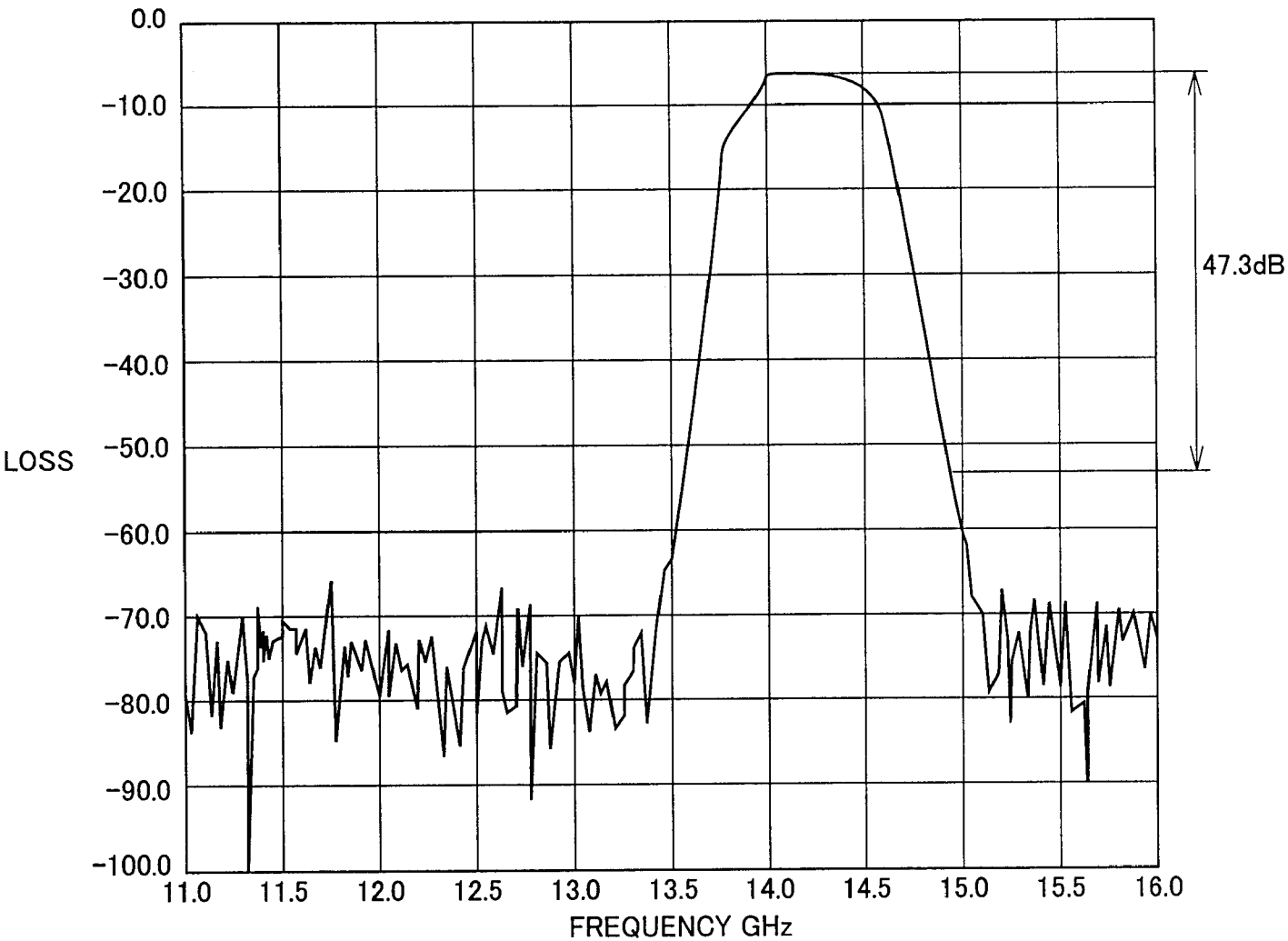
FIG. 10 shows cutoff characteristics obtained by connecting the half-wave bandpass filter and low-pass filter shown in FIG. 5 in series.

FIG. 9 shows cutoff characteristics of the low-pass filter of the present invention, and FIG. 10 shows cutoff characteristics of the combination of the half-wave bandpass filter and low-pass filter shown in FIG. 5 and high-frequency amplifiers 410 and 411.

Figure 13:
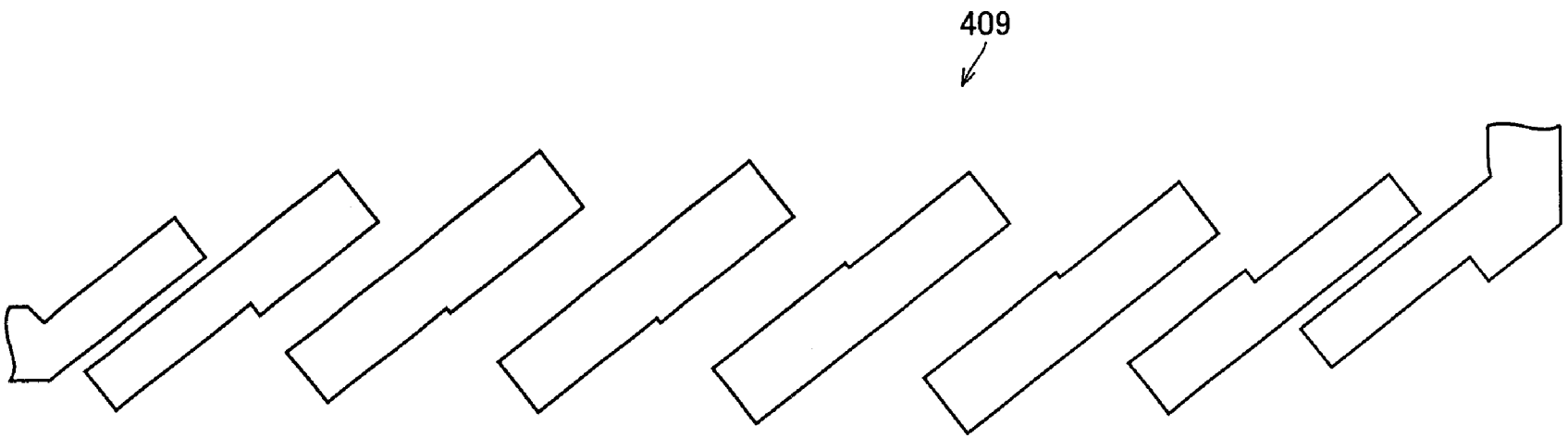
FIG.13 PRIOR ART
FIG. 13 shows a shape of a half-wave bandpass filter used in the high-frequency transmitter shown in FIG. 12.
Figure 14:
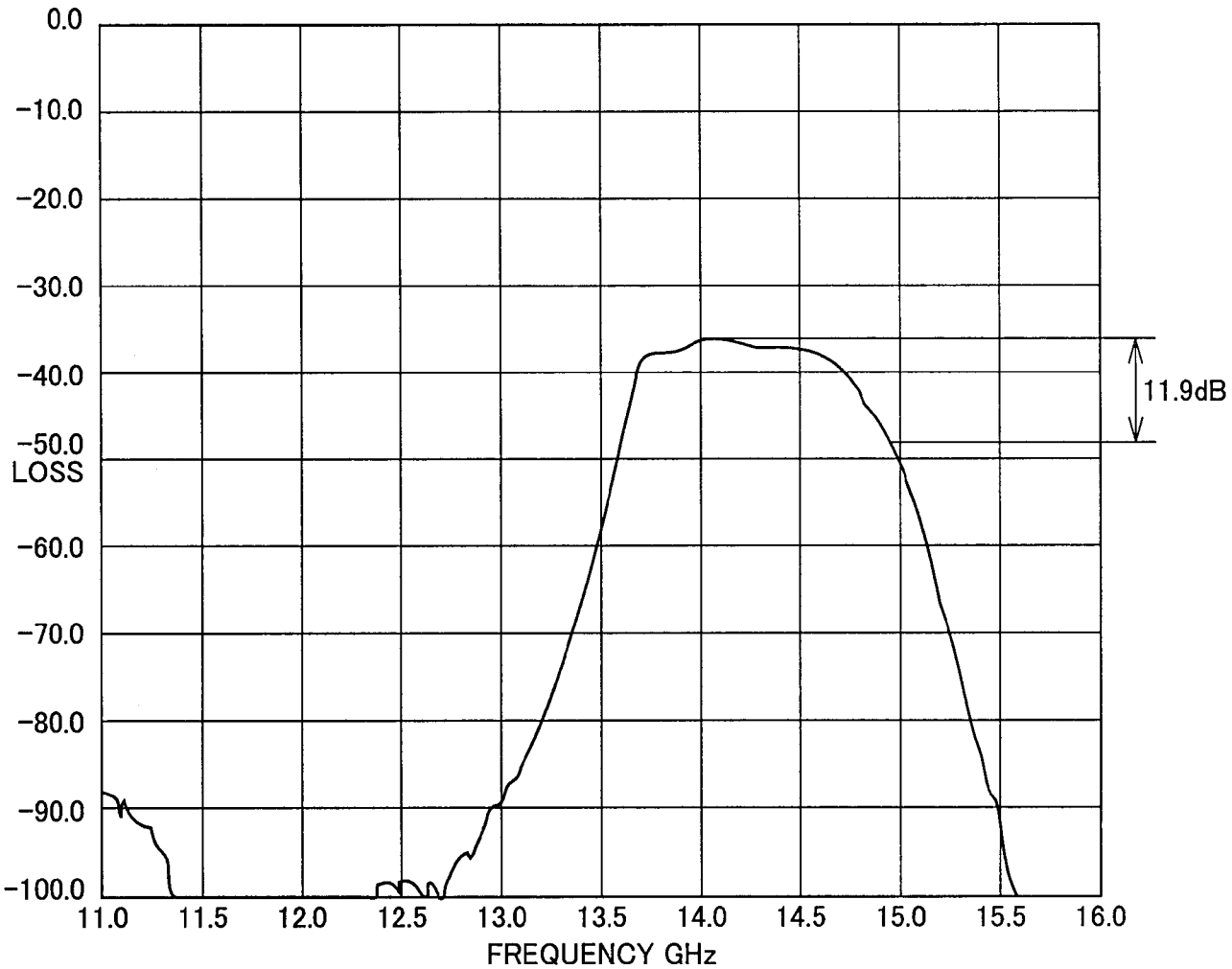
FIG.14 PRIOR ART
FIG. 14 shows cutoff characteristics of a combination of the conventional half-wave bandpass filter and high-frequency amplifiers.

Low-pass filter 417 has cutoff characteristics as shown in FIG. 9 and, as shown in FIG. 10, overall characteristics of bandpass filter 409, low-pass filter 417 and two-stage high-frequency amplifiers 410 and 411 exhibit the amount of attenuation of 47.3 dB at 14.95 GHz relative to the level in the passband. Here, this combination achieves the attenuation of 47.3 dB while the attenuation by the conventional bandpass filter 409 shown in FIG. 14 is merely 11.9 dB. It is thus seen that an improvement of 35.4 dB from 11.9 dB to 47.3 dB is obtained. In this way, this embodiment provides a greater amount of attenuation out of the passband and a smaller in-band deviation as compared with use of only the conventional half-wave bandpass filter 409 shown in FIG. 13. Consequently, the spurious elimination feature is enhanced.

As heretofore discussed, according to the embodiment of the present invention, a plurality of composite elements each are constituted of a rectangular microstrip line element, an input microstrip line and an output microstrip line, and the composite elements are arranged in parallel and cascaded on a substrate to constitute a low-pass filter providing a large amount of attenuation out of the passband and a small deviation within the passband to be improved in the spurious elimination characteristics. Specifically, out-of-band attenuation of at least 40 dB is achieved all the time above the higher limit of the passband, without deterioration in in-band deviation characteristics, and accordingly, spurious elimination characteristics above 14.95 GHz is accomplished.

Moreover, the low-pass filter of the present invention includes the composite elements arranged so that the composite elements adjacent to each other are symmetrical with respect to the center line between connected input line and output line of respective composite elements adjacent to each other. The composite elements thus arranged occupy a minimum area as compared with the simply cascaded composite elements.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microstrip line filter formed on a substrate, comprising a plurality of composite elements arranged in parallel with each other, said composite elements each including a rectangular microstrip line element, an input microstrip line and an output microstrip line that are formed on said substrate, and said composite elements being connected to constitute a low-pass filter, wherein said composite elements adjacent to each other have respective input microstrip line and output microstrip line connected to each other.

2. The microstrip line filter according to claim 1, wherein rectangular microstrip line elements of said composite elements differ in the length of longer side.

3. The microstrip line filter according to claim 2, wherein said rectangular microstrip line elements include outer microstrip line elements and inner microstrip line elements and said inner microstrip line elements have longer sides shorter than those of said outer microstrip line elements to obtain desired input/output impedance characteristics, in-band pass characteristics and out-of-band attenuation characteristics.

4. The micro strip line filter according to claim 1, wherein a half-wave bandpass filter connected in series to said low-pass filter is further formed on said substrate.

5. The microstrip line filter according to claim 4, wherein said half-wave bandpass filter includes a plurality of rectangular microstrip line elements arranged in parallel with each other at predetermined intervals and inclined at a certain angle, and halves of respective longitudinal sides of said microstrip line elements are opposite to halves of respective longitudinal sides of adjacent microstrip line elements.

6. The microstrip line filter according to claim 1, wherein said rectangular microstrip line element has one longer side, the other longer side, one end and the other end, said input microstrip line is connected at said one end to said one longer side, and said output microstrip line is connected at said other end to said other longer side.

7. The microstrip line filter according to claim 1, wherein the adjacent composite elements are symmetrical with respect to a center line between the input microstrip line and the output microstrip line connected to each other.

8. The microstrip line filter according to claim 1, wherein microstrip line elements of said composite elements are arranged symmetrically with respect to a center line of the arrangement of said composite elements, and said microstrip line filter includes a metal casing having a partition on said center line and covering microstrip line elements of said composite elements.

9. The microstrip line filter according to claim 1, wherein microstrip line elements of said composite elements have respective input microstrip lines and respective output microstrip lines that connect the microstrip line elements and that have respective widths selected to obtain desired input/output impedance characteristics, in-band pass characteristics and out-of-band attenuation characteristics.

10. A high-frequency transmitter converting an intermediate-frequency signal into a high-frequency signal and transmitting the high-frequency signal, comprising:

a mixer circuit combining said intermediate-frequency signal with a local oscillator signal;

a filter circuit connected to an output of said mixer circuit; and a high-frequency amplifier circuit connected to an output of said filter circuit, said filter circuit being formed on a substrate and including a half-wave bandpass filter including a plurality of rectangular microstrip line elements arranged in parallel with each other at predetermined intervals and inclined at a certain angle, halves of respective longitudinal sides of said microstrip line elements being opposite to halves of respective longitudinal sides of adjacent microstrip line elements and a low-pass filter including a plurality of composite elements arranged in parallel with each other and cascaded, said composite elements including respective rectangular microstrip line elements, respective input microstrip lines and respective output microstrip lines, wherein said composite elements adjacent to each other have respective input microstrip line and output microstrip line connected to each other.

11. A microstrip line filter formed on a substrate, comprising a plurality of composite elements arranged in parallel with each other, said composite elements each including a rectangular microstrip line element, an input microstrip line and an output microstrip line that are formed on said substrate, and said composite elements being cascade connected to each other on the substrate to constitute a low-pass filter.

* * * * *